US005080414A

United States Patent [19]

Hellquist et al.

[11] Patent Number: 5,080,414

[45] Date of Patent: Jan. 14, 1992

[54] LOCKING DEVICE FOR ATTACHING A GAS CYLINDER IN A PORTABLE CYLINDER HOLDER

[75] Inventors: Ivan Hellquist, Sollentuna; Erik Svantesson, Taby, both of Sweden

[73] Assignee: Interspiro AB, Lidingo, Sweden

[21] Appl. No.: 500,110

[22] Filed: Mar. 27, 1990

Related U.S. Application Data

[63] Continuation of Ser. No. 880,846, Jul. 1, 1986, abandoned.

[30] Foreign Application Priority Data

Jul. 15, 1985 [SE] Sweden ..... 8503472

[51] Int. Cl.[5] ..... B66C 1/66

[52] U.S. Cl. ..... 294/31.1; 294/145; 248/311.3

[58] Field of Search ..... 294/27.1, 28, 31.1, 294/31.2, 137, 145, 110.1; 206/446; 215/100 A; 248/311.3, 154; 211/71, 81; 222/160, 162, 180; 24/610, 611, 615

[56] References Cited

U.S. PATENT DOCUMENTS

| | | | |
|---|---|---|---|
| 2,162,961 | 6/1939 | Mattoon | 294/31.1 X |
| 2,598,747 | 6/1952 | Alex | 294/27.1 |
| 3,101,211 | 8/1963 | Jones | 294/31.1 |
| 3,285,650 | 11/1966 | Dukes | 294/110.1 X |
| 3,480,317 | 11/1969 | Bayless | 294/31.1 |
| 3,791,403 | 2/1974 | Folkerth | 211/71 X |
| 3,845,963 | 11/1974 | Price | 279/89 |
| 4,067,627 | 1/1978 | Hodge | 248/311.3 X |
| 4,241,946 | 12/1980 | Spoeth, Jr. | 294/31.1 |
| 4,624,495 | 11/1986 | Marsh | 294/31.2 |

FOREIGN PATENT DOCUMENTS

| | | |
|---|---|---|
| 318480 | 8/1969 | Sweden . |
| 1325049 | 8/1973 | United Kingdom . |

*Primary Examiner*—Margaret A. Focarino
*Assistant Examiner*—Dean J. Kramer
*Attorney, Agent, or Firm*—Pollock, Vande Sande & Priddy

[57] ABSTRACT

A carrying holder for a gas cylinder in a respirator is provided with a device for attachment and detachment of the cylinder in the carrying holder. The device includes a recess provided on the carrying holder, and is adapted to receive a support plate provided on the valve of the gas cylinder, and also a locking latch which, in the locking position, grips a support surface on the valve. The locking latch rotates around a shaft and is activated by a spring to assume the locked position.

1 Claim, 2 Drawing Sheets

LOCKING DEVICE FOR ATTACHING A GAS CYLINDER IN A PORTABLE CYLINDER HOLDER

This application is a continuation of Ser. No. 06/880,846, filed on July 1, 1986 now abandoned.

BACKGROUND OF THE INVENTION

This invention concerns a device for attaching and detaching a valved gas cylinder in a fixed position in a portable holder.

Respirators of the type in which exhaled air is released to the atmosphere normally comprise a gas cylinder for respiration air, pressure regulator, a mask with respiration valve and a carrying holder.

In one known embodiment the pressure regulator with its cylinder connection is fixed to the carrying holder in which case the cylinder, when connected to the regulator, is fixed in the carrying holder with the cylinder valve pointing downwards. The cylinder is also held in place with a strap on the carrying frame, the strap being tightened around the cylinder at a suitable distance from the cylinder valve.

In another known embodiment the pressure regulator and respiration valve comprise a unit separate from the carrying holder. In this case the cylinder is first fixed in the carrying holder, after which the pressure regulator is connected to the cylinder valve, which does not involve any fixing of the cylinder in the carrying holder. The valve end of the cylinder is instead fixed and held in place by a fixture on the cylinder which is hooked into the carrying holder, or by providing the carrying holder with a clamp through which the valve is introduced, and which then supports the shoulder of the cylinder. The clamp must be dimensioned for cylinders of varying diameter, which means that the possibility of exact positioning of the cylinder valve is unsatisfactory in this case.

SUMMARY OF THE INVENTION

To allow quick and reliable positioning and locking of a gas cylinder in the carrying holder, this invention involves a locking device of the first-mentioned type, which is characterised by a cup-shaped recess on the holder, intended to receive a support plate on the cylinder valve, so that the recess and support plate are designed in such a way that the cylinder can only assume one position regarding axial rotation, and a locking latch which can swing between a position in which it engages a supporting surface on the cylinder valve, and an open position, in addition to which the locking latch is pressed by a spring into the locking position.

The device according to this invention is intended for gas cylinders provided with a valve of the type which has a support plate, and a lateral gas outlet connection, and preferably also a built-in pressure valve.

The invention is described in greater detail below with reference to the attached drawings, which show the locking latch in two different positions.

DESCRIPTION OF THE PREFERRED EMBODIMENTS

Figure 1:
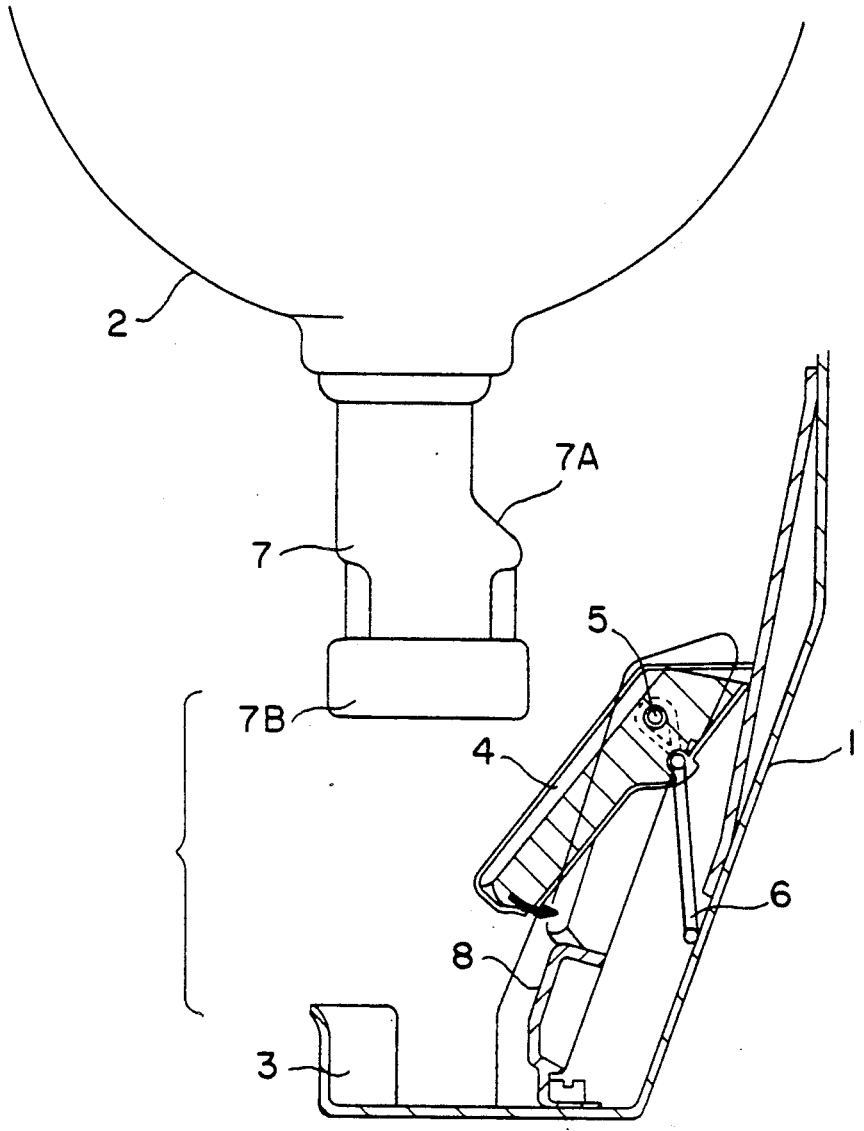
FIG. 1 shows the device before a cylinder is fixed in position.

The locking device shown in the Figures is embodied into a carrying holder 1, of which only the lower part is shown, and which is intended to support a gas cylinder 2, which is also only partly shown.

At the lower part of the carrying holder 1 there is a cup-shaped recess 3, and obliquely above this a locking latch 4, which pivots around a shaft 5. The locking latch 4 is activated by a spring 6 to assume the position shown in FIG. 1. The gas cylinder 2 is provided with a valve 7, which has an oblique support surface *7a* and a support plate *7b*, which can, for example, have rhombic outlines.

Figure 2:
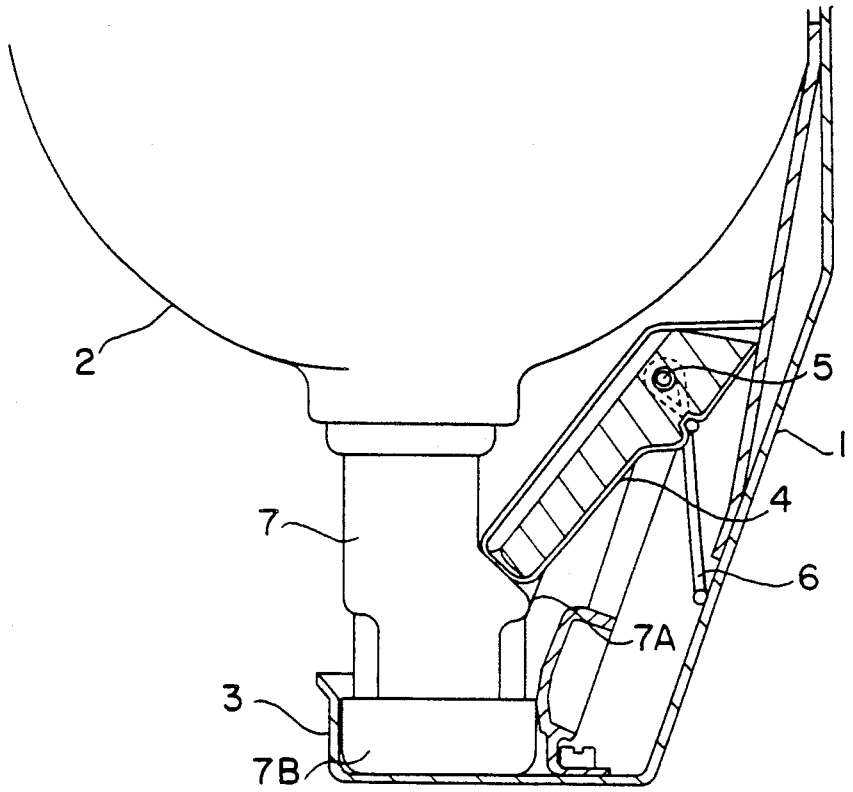
FIG. 2 shows the same device with the gas cylinder clamped in position.

When the gas cylinder 2 is lowered from the position shown in FIG. 1, the support plate *7b* comes into contact with the locking latch 4, which swings away against the action of the spring 6 to the depressed position indicated in the figure. In this position the locking latch, together with the underlying wall surface 8, provide an oblique guiding surface which guides the valve 7 towards the recess 3. When the gas cylinder is lowered further, so that the support place comes into contact with the bottom of the recess 3, the locking latch 4 returns under the activation of the spring 6, so that the lower part of the locking latch engages the supporting surface *7a*, as shown in FIG. 2. In this position the support plate *7b* is surrounded by the recess 3, which has a corresponding rhombic shape, and the gas cylinder is thereby prevented from being pulled out or rotated.

The device can also be used for gas cylinders with diameters smaller than the one shown, due to the fact that the valve is in any case steered into the correct position by the steering surface mentioned. In such cases the gas cylinder will assume a position at a slight angle to the carrying holder, but this does not involve any practical disadvantage.

When the valve end of the cylinder has been fixed in the correct position as shown in FIG. 2, the cylinder is fastened with a strap (not shown) on the carrying holder, placed at a suitable distance above the lower end of the cylinder.

When the cylinder is to be removed from the carrying holder, the strap is first released, after which the locking latch 4 is pushed in manually. The gas cylinder can then easily be lifted out of the locking device.

We claim:

1. A system comprising:

a gas cylinder;

a valve connected at one end to said gas cylinder, said valve having a support plate at an opposite end thereof and an oblique support surface intermediate said ends of said valve; and a carrying holder comprising:

an elongated housing;

a cup-shaped member provided on a lower portion of said housing for receiving and holding therein said support plate of the valve in a fixed position for preventing its axial rotation; and a spring-loaded locking latch member having upper and lower ends, said upper end being pivotally mounted on said housing substantially above said cup-shaped member, said locking latch member defining an oblique guiding surface along its longitudinal surface for guiding the support plate into said cupshaped member, said locking latch member being swingable between opened and locked positions, and being activated into said opened position against the action of a spring by said support plate during its insertion into said cup-shaped member, said locking latch member being activated by said spring into said locked position to pressingly engage said oblique support surface on the valve with the second end of said locking latch member to fixedly hold said support plate supported in said cup-shaped member.

* * * * *